US007165791B2

(12) United States Patent
Rebel et al.

(10) Patent No.: US 7,165,791 B2
(45) Date of Patent: Jan. 23, 2007

(54) POSITIVE ACTION FENESTRATION LOCK

(76) Inventors: Jacob Rebel, 4353 Callaghan Crescent, Abbotsford, B.C. (CA) V3G 2Z1; Kai Zhang, #43-20540 66th Avenue, Langley, B.C. (CA) V2Y 2Y7

( * ) Notice: Subject to any disclaimer, the term of this patent is extended or adjusted under 35 U.S.C. 154(b) by 108 days.

(21) Appl. No.: 11/004,460

(22) Filed: Dec. 6, 2004

(65) Prior Publication Data

US 2006/0038413 A1 Feb. 23, 2006

(30) Foreign Application Priority Data

Aug. 18, 2004 (CA) ..... 2477933

(51) Int. Cl.
*E05C 1/02* (2006.01)
*E05C 19/10* (2006.01)

(52) U.S. Cl. ..... 292/137; 292/221; 292/227; 292/DIG. 37

(58) Field of Classification Search ..... 292/137, 292/221, 227, 334–336, DIG. 37, 182, 178, 292/DIG. 20, 170, 165
See application file for complete search history.

(56) References Cited

U.S. PATENT DOCUMENTS

| | | | | | |
|---|---|---|---|---|---|
| 959,559 | A * | 5/1910 | Landis | 292/336 |
| 1,076,650 | A * | 10/1913 | Eddy | 292/336 |
| 2,777,721 | A * | 1/1957 | Burke et al. | 292/332 |
| 2,874,986 | A * | 2/1959 | Henrichs | 292/167 |
| 3,881,758 | A * | 5/1975 | Gross | 292/87 |
| 4,029,916 | A * | 6/1977 | Chu | 200/5 A |
| 4,124,787 | A * | 11/1978 | Aamoth et al. | 200/6 A |
| 5,115,108 | A * | 5/1992 | Ogawa et al. | 200/1 B |
| 5,378,862 | A * | 1/1995 | Tasaka et al. | 200/6 A |
| 5,577,080 | A * | 11/1996 | Sakaue et al. | 375/376 |
| 5,901,501 | A * | 5/1999 | Fountaine | 49/449 |
| 6,502,435 | B1 | 1/2003 | Watts et al. | |
| 6,550,824 | B1 | 4/2003 | Ramsauer | |
| 6,722,710 | B1 * | 4/2004 | Cowper | 292/137 |
| 6,764,115 | B1 * | 7/2004 | Speed et al. | 292/334 |
| 6,848,728 | B1 * | 2/2005 | Rotondi et al. | 292/336 |
| 6,962,374 | B1 * | 11/2005 | Belloma et al. | 292/26 |
| 7,004,515 | B1 * | 2/2006 | Timothy | 292/137 |
| 2003/0168867 | A1 | 9/2003 | Sclater et al. | |

FOREIGN PATENT DOCUMENTS

GB 2056540 A * 3/1981

* cited by examiner

*Primary Examiner*—Gary Estremsky
*Assistant Examiner*—Mark Williams
(74) *Attorney, Agent, or Firm*—Frederick Kaufman

(57) ABSTRACT

A positive action fenestration lock, i.e. adaptable to be attached to a moving window profile and to interact, by sliding, with a fixed window profile, said positive action fenestration lock comprises: a hollow body closed by a base plate; a bolt-wedge displaceable rectilinearly with respect to the hollow body and the base plate, respectively; a button located generally in the hollow body and pivotally connected to the base; an actuator and a flat spring, the latter being attached to the former, controlling together the rectilinear movement of the bolt-wedge, while the latter is activated by the button; a pair of restoring torsion springs, located between the base plate and the button, for resisting against a torque caused by the button, the latter being adaptable to be finger pressed by an operator; and a helical compression spring acting permanently on the actuator and, impliedly, on the flat spring.

2 Claims, 9 Drawing Sheets

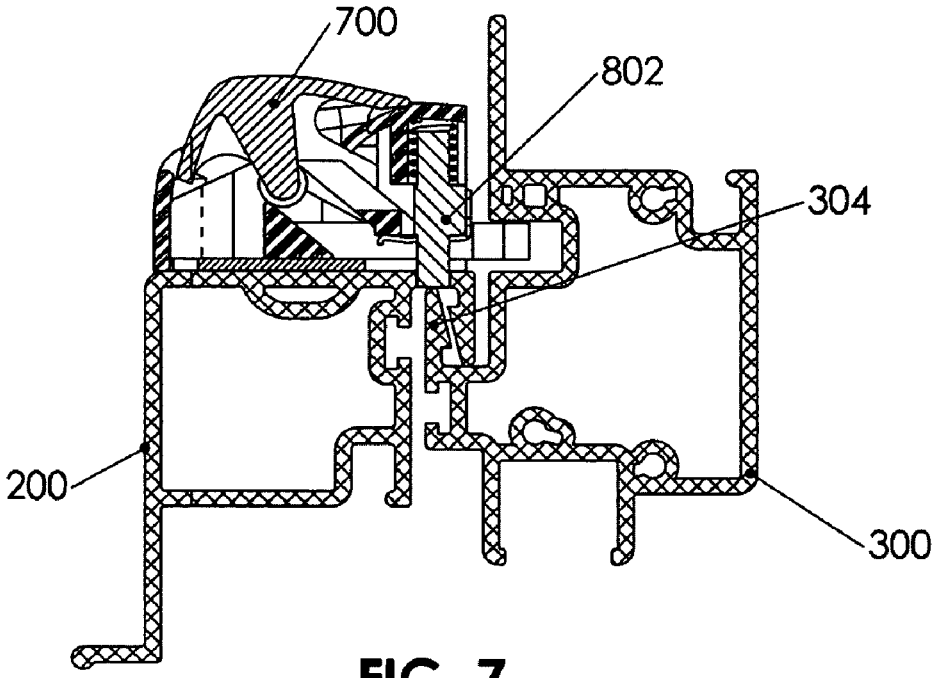
FIG. 7
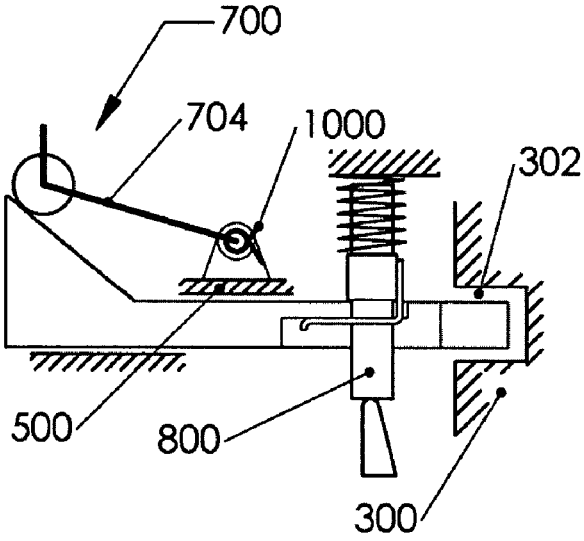
FIG. 7'
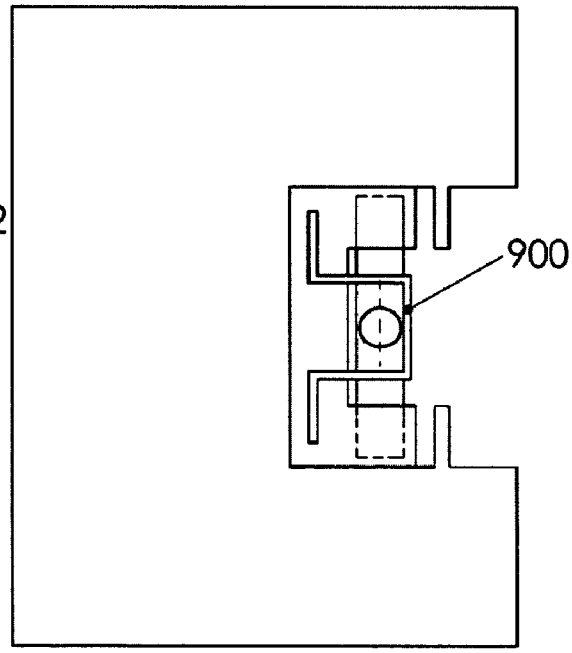
FIG. 7"

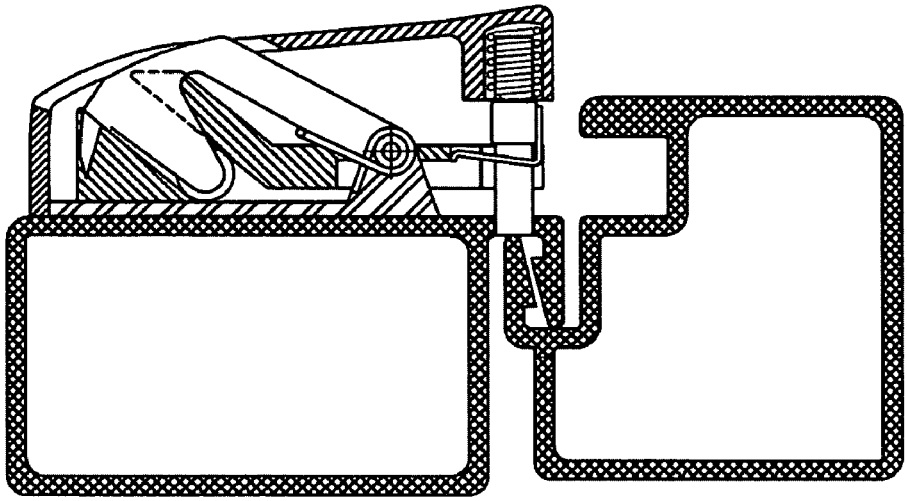
FIG.8
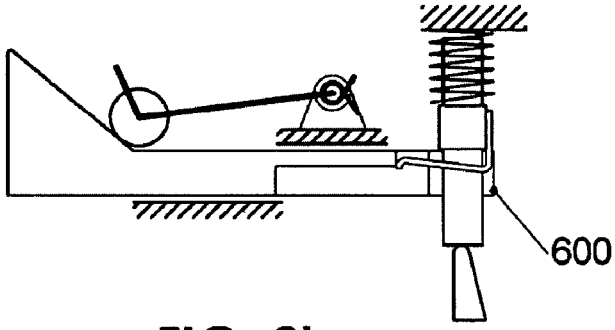
FIG. 8'
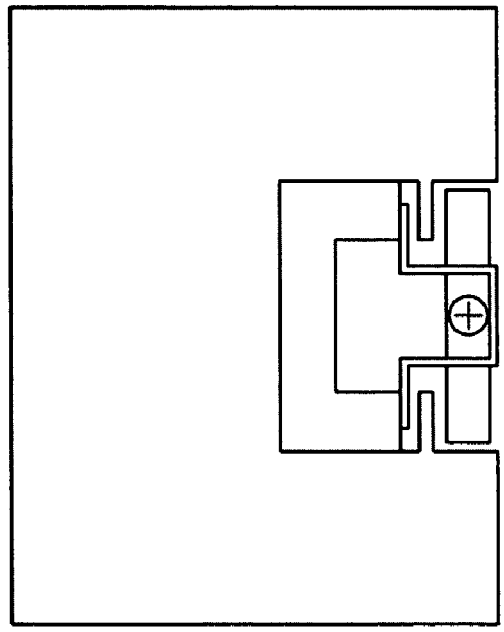
FIG. 8"

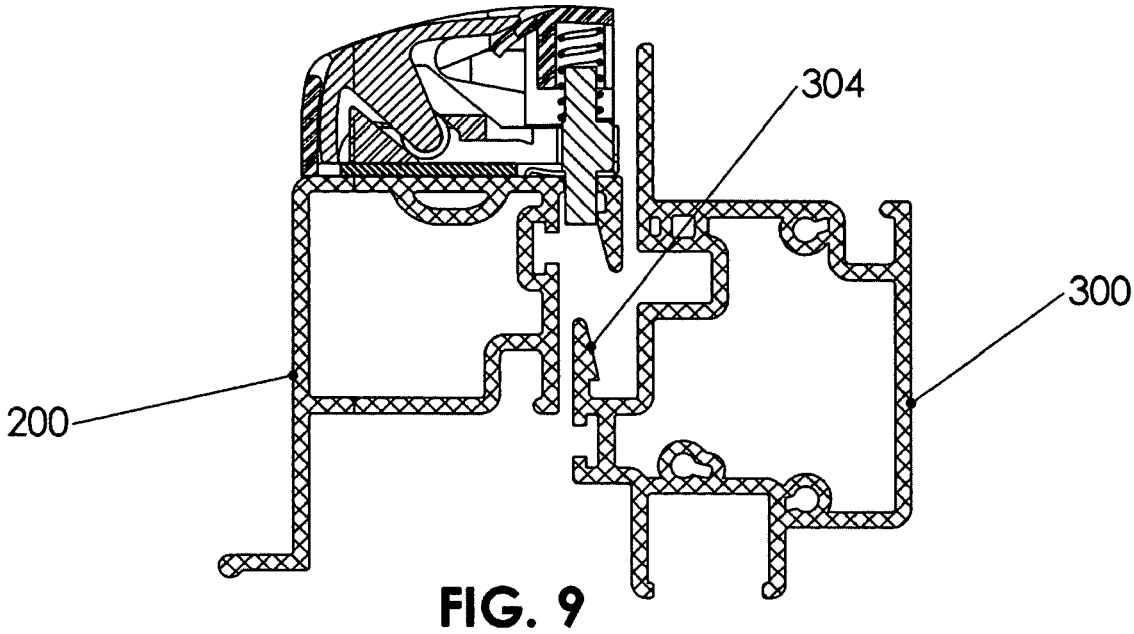
FIG. 9
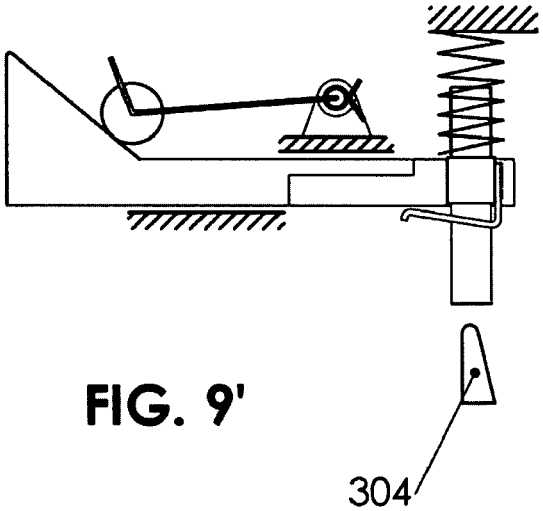
FIG. 9'
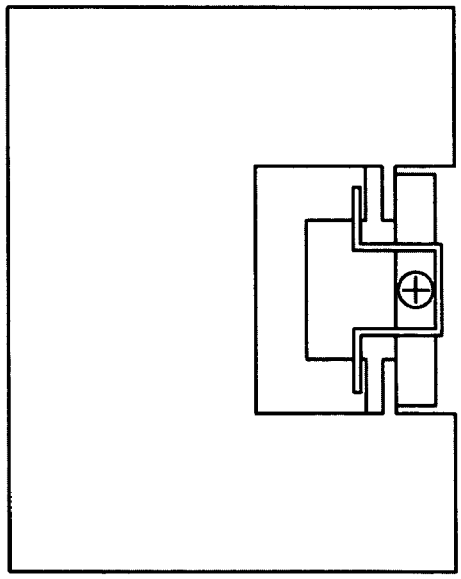
FIG. 9"

POSITIVE ACTION FENESTRATION LOCK

I. BACKGROUND OF THE INVENTION

1. Field of the Invention

The present invention relates to snap locks in general and, more specifically, to a positive action fenestration lock, i.e. adaptable to be attached to a moving window profile and to interact, by sliding, with a fixed window profile.

2. Description of the Prior Art

The particular class of latches to which the present invention pertains uses latching plates with latching shoulders, between which a land to provide an abutment is formed. The latching shoulders are inclined with respect to a vertical surface of a widow frame. For example, U.S. Pat. No. 5,901,501 dated May 11, 1999 and granted to Fountaine for a "Window Fastener" describes a lock for use with a sliding sash window. The lock has a body with a handle mounted with the body for pivotal movement about a pivot axle. A latch tongue is operatively coupled to the handle and a latch tongue is provided with a latching surface for contacting an end of the latch tongue. The latching surface is spaced from the pivot axle in the direction in which a sash of a window is movable from a closed position elative to the frame of the window. The handle is movable about the pivot axle to move the end of the latch tongue away from its latching contact of the latching surface of the latch plate. Thus, the window sash can be moved from the closed position. Fountain's "Window Fastener" has several important shortcomings. First, the latching tongues are moveable independent of each other and of the handle. Second, there is a limited pivot movement of the tongues by the handle. Third, sliding action is not rectilinear.

II. SUMMARY OF THE INVENTION

Based on the analysis of the prior art, there is a need for a positive action fenestration lock which eliminate or, at least, alleviate the foregoing shortcomings.

A first objective of the present invention is to provide a simple and reliable positive action fenestration lock.

A second objective of the present invention is to provide a positive action fenestration lock with a rectilinear movement of the latching element.

A third objective of the present invention is to develop a positive action fenestration lock provided with security means.

A forth objective of the present invention is to provide a positive action fenestration lock with extended service life.

A fifth objective of the present invention is to provide a positive action fenestration lock that satisfies the demands of technical aesthetics.

Broadly stating, according to the present invention, a positive action fenestration lock, i.e. adaptable to be attached to a moving window profile and to interact, by sliding, with a fixed window profile, said positive action fenestration lock comprises a hollow body closed by a base plate;

a bolt-wedge displaceable rectilinearly with respect to the hollow body and the base plate, respectively;

a button located generally in the hollow body and pivotally connected to the base;

an actuator and a flat spring, the latter being attached to the former, controlling together the rectilinear movement of the bolt-wedge, while the latter is activated by the button;

a pair of restoring torsion springs, located between the base plate and the button, for resisting against a torque caused by the button, the latter being adaptable to be finger pressed by an operator; and a helical compression spring acting permanently on the actuator and, impliedly, on the flat spring.

In one aspect of the present invention, the hollow body includes a front wall, a pair of lateral walls, generally perpendicular to the front wall, and an upper inclined wall extending into the front wall and the pair of lateral walls. Opposite to the front wall, a pair of spaced blocks, having a rectangular cross-section, extends inwardly from and perpendicularly on the upper inclined wall. The pair of spaced blocks has a height similar to a height of the pair of lateral walls, minus a thickness of the base plate compounded with a thickness of an adjacent part of the bolt-wedge. Between the pair of spaced blocks, a central block, having a cylindrical blind hole and a height relatively shorter than the height of the pair of spaced blocks, is provided. Adjacent to each one of the pair of lateral walls and opposite to the front wall, i.e. in each corner formed between each one of the pair of lateral walls and the upper inclined wall, a double sleeve projecting from the upper inclined wall is joined to a proximate one of the pair of lateral walls. Each double sleeve incorporates a through hole and a dead hole contiguous to the latter, the former and the latter being perpendicular to the base plate. A sleeve, extending from the front wall and from the upper inclined wall, is also provided. Thus, a pair of sleeves, equally spaced from the midway between the pair of lateral walls is formed. Each sleeve incorporates a dead hole equivalent to the dead hole. A height of the double sleeves and the sleeves is shorter than a height of the front wall and the pair of lateral walls. The foregoing difference in height is equal to a thickness of the base plate that is inserted into the hollow body. The upper inclined wall incorporates a window generally sized to enable a passage of the button. The base plate includes a pair of lugs struck from and perpendicularly disposed on it. The pair of lugs is so positioned as to partly flank the pair of spaced blocks. A pair of axles extends perpendicularly from the pair of lugs and is parallel to the base plate. The base plate has a length commensurate with an internal distance between the pair of lateral walls and a width commensurate with an internal distance measured between the front wall and outward ends of the pair of spaced blocks. The base plate further comprises a rectangular cut-off centrally situated under the central block and so dimensioned as to allow a movement of the actuator. An elongated cut-off intended for a location of the button, respectively a lower end portion of it, is disposed oppositely to the rectangular cut-off. The base plate incorporates as well several apertures that correspond in size and coincide with the through and dead holes.

The bolt-wedge includes generally a flat base of rectangular shape, defined by longitudinal and transversal axes, while a slanted wall protruding, proximately to the longitudinal axis, from the flat base is directed towards the front wall of the hollow body. The slanted wall is equally divided by a skewed slot that coincides with the transversal axis. A first end of said flat base, partly situated beneath the slanted wall is slope-shaped. A second end, opposite to the first end is provided with a first rectangular-shaped recess, the latter having such a width that allows a free passage of the actuator, respectively a widest portion of it. A movement of the actuator is directed perpendicularly to the flat base, in opposite directions. The first rectangular-shaped recess is followed inwardly by a pair of opposite protrusions extending towards the transversal axis. Behind the pair of opposite protrusions, a second rectangular-shaped recess, having a width somewhat larger than a width of the first rectangular-shaped recess and extend in the second rectangular-shaped recess, is provided. A third rectangular-shaped recess extending up to the slanted wall and having a width commensurate with a distance between the pair of opposite protrusions and communicating with the second rectangular-shaped recess is provided. The latter communicates with the first rectangular-shaped recess. The flat base incorporates a depressed zone having a hollowness that starts from a bottom of the former. The depressed zone extends longitudinally and transversally outside the third rectangular-shaped recess and has a width commensurate with the second rectangular-shaped recess. The depressed zone terminates with a rounded shoulder directed towards the pair of opposite protrusions. The button comprises a curve-shaped structure having at its lateral extremities a pair of projecting arms extending perpendicularly from a bottom surface of the former, i.e. inwardly at 90° with respect to the foregoing curve-shaped structure. The pair of projecting arms is provided at its ends with a pair of engaging holes for fitting with the pair of axles. A lever, ending with a divided-in-two axle perpendicularly to it, projects from the bottom surface, midway between the pair of projecting arms. A pair of bushes is mounted on the divided-in-two axle. The bolt-wedge is able to slide on the base plate, while the pair of restoring torsion springs acts against the pair of projecting arms, from beneath them. In a first case, when pressing the button, the divided-in-two axle, via the pair of bushes acts on the slanted wall; in a second case, when closing the moving window profile, the divided-in-two axle, via the pair of bushes acts on the first end of the flat base. The actuator includes a parallelepiped-shaped block provided with a pair of cylindrical elements extending centrally and in opposite directions from an upper and lower face of the parallelepiped-shaped bloc. A pair of posts flanks the parallelepiped-shaped block, respectively its lateral faces. Each of the pair of posts has a rectangular cross-section and is forwardly coplanar with a front face of the parallelepiped-shaped block. The latter is provided with a pair of fastening apertures. An external distance between the pair of posts corresponds to a width of the first rectangular-shaped recess and to the rectangular cut-off. The flat spring comprises a front plate corresponding in size to a front face of the parallelepiped-shaped block and has a pair of through apertures coinciding with the pair of fastening apertures. A pair of branches, extending from the front plate, forms an inclination somewhat less than 90° between the former and the latter. Thus, when the front plate is assembled to the front face of the parallelepiped-shaped block, the pair of branches is upwardly biased. Each one of the pair of branches terminates with a lateral arm that extends outwardly and is curved downwardly. A pair of fasteners is used to attach the front plate to the front face of the parallelepiped-shaped block. The pair of restoring torsion springs is assembled on the pair of axles of the base plate, each one of the pair of restoring torsion springs having one end tensioned against one of the pair of projecting arms, while another end is tensioned against the base plate The helical compression spring is mounted around one of the pair of cylindrical elements that extends centrally from the upper face of the parallelepiped-shaped block, so that, together the helical compression springs and one of the pair of cylindrical elements that extends centrally from the upper face of the parallelepiped-shaped bloc are disposed into the cylindrical blind hole of the central block. Thus, the helical compression spring acts permanently on the upper face of the parallelepiped-shaped bloc.

III. BRIEF DESCRIPTION OF THE DRAWINGS

Although the characteristic features of the invention will be particularly pointed out in the claims, the invention itself and the manner in which it may be made and used may be better understood by referring to the following description and accompanying drawings. Like reference numerals refer to like parts throughout the several views of the drawings in which:

Figure 1:
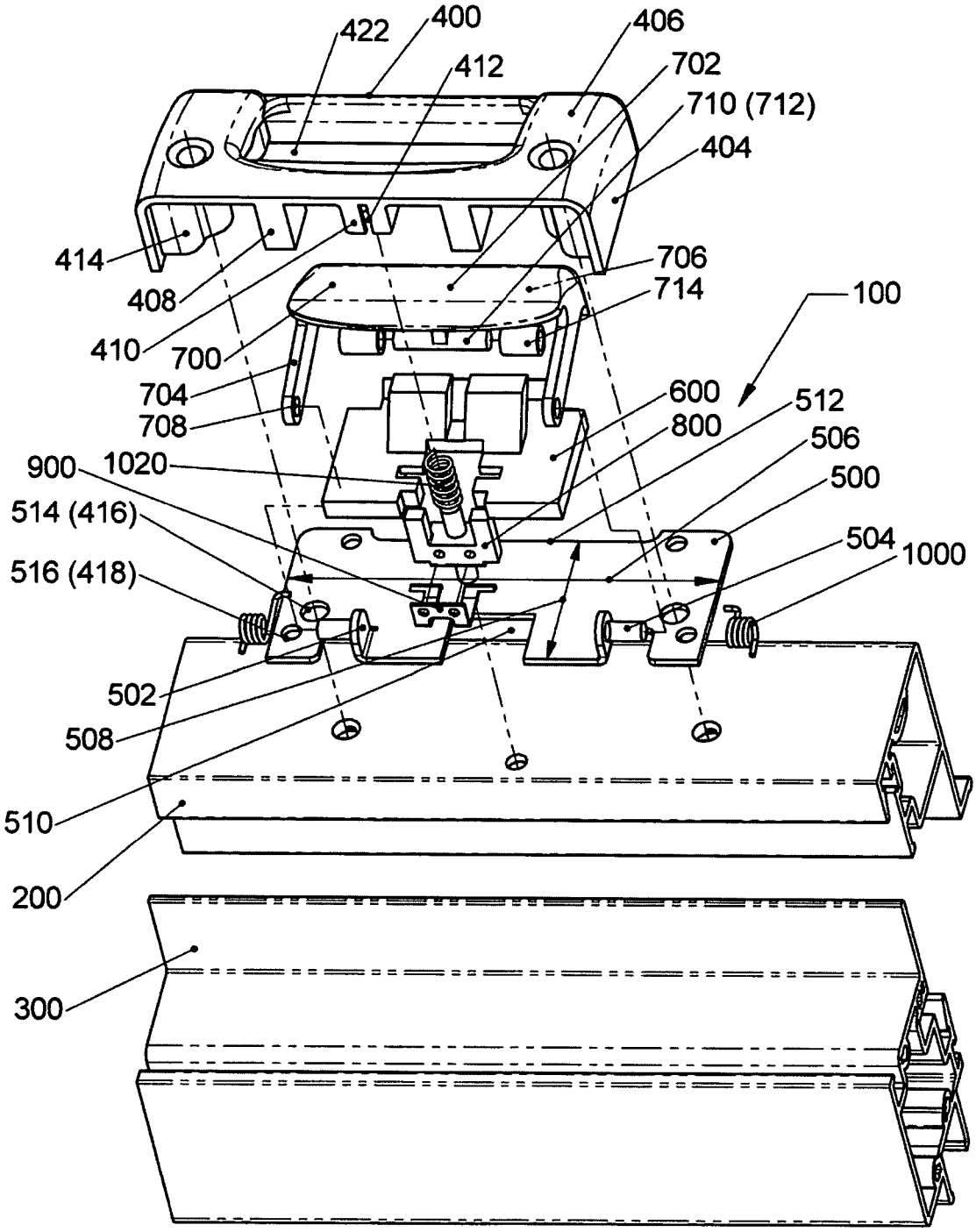
FIG. 1 illustrates an exploded view of the positive action fenestration lock of the present invention.
Figure 2:
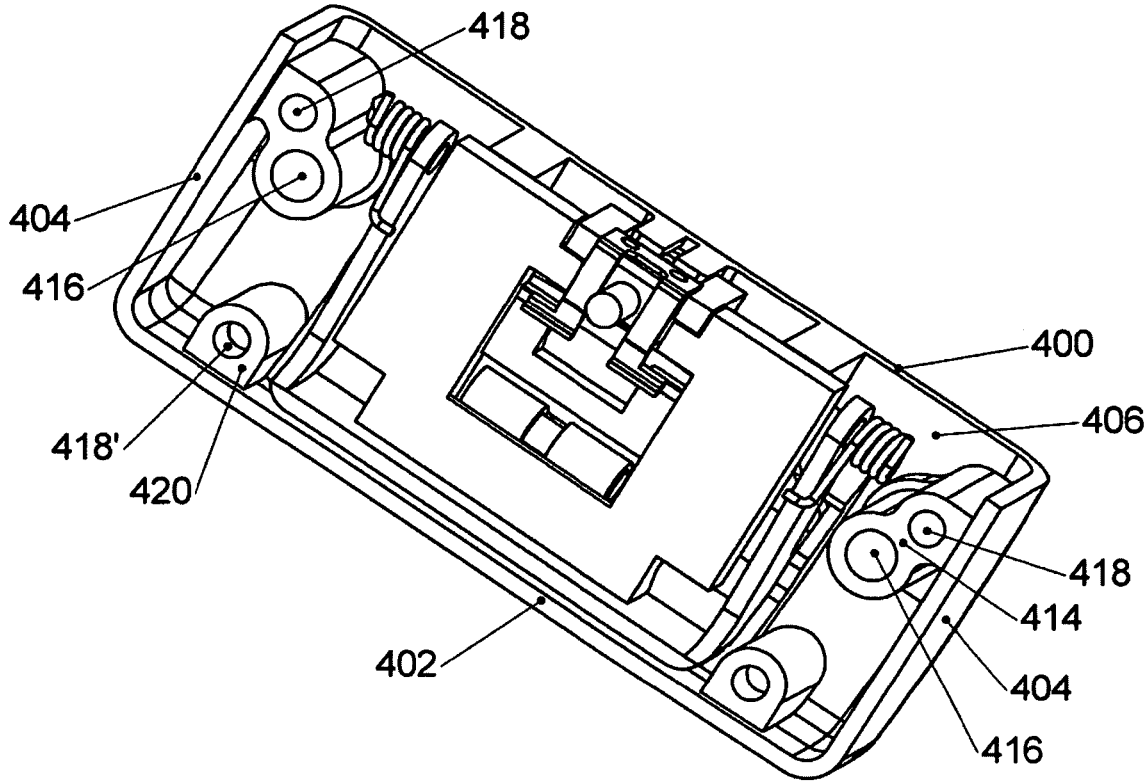
FIG. 2 illustrates a perspective view from the bottom, without a base plate, of the positive action fenestration lock.
Figure 3:
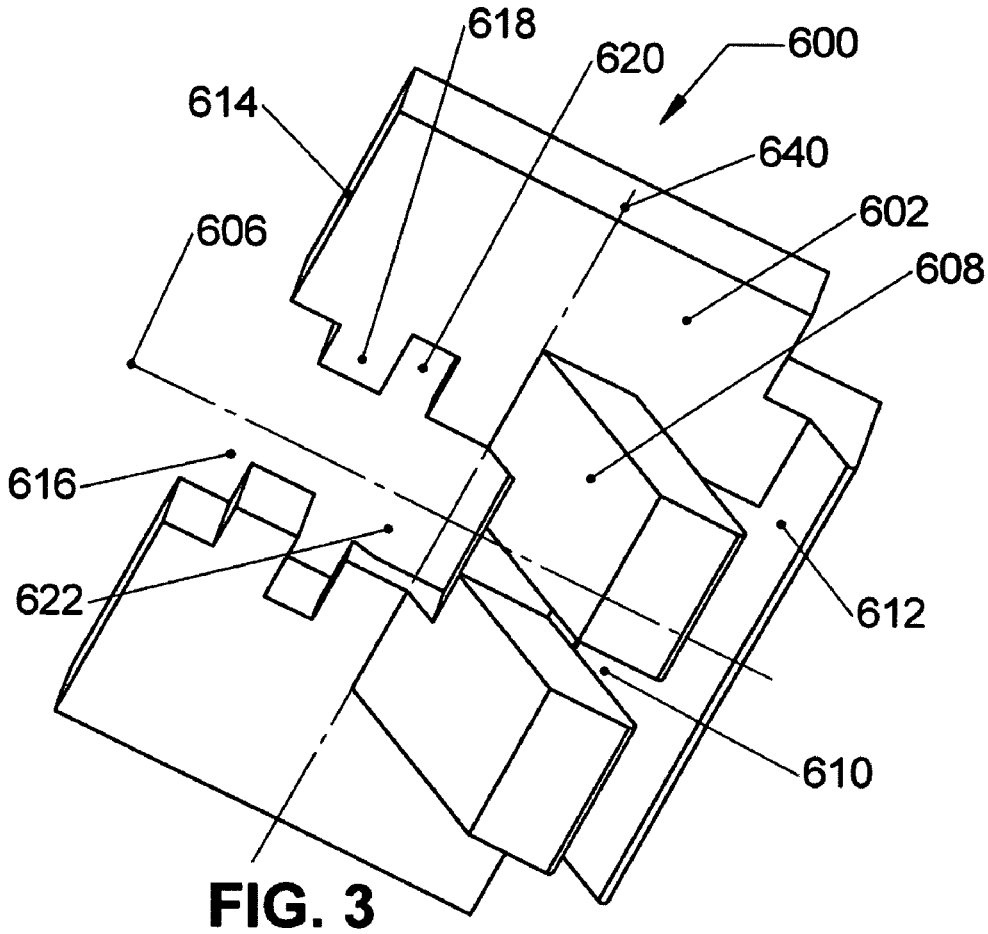
Figure 3:
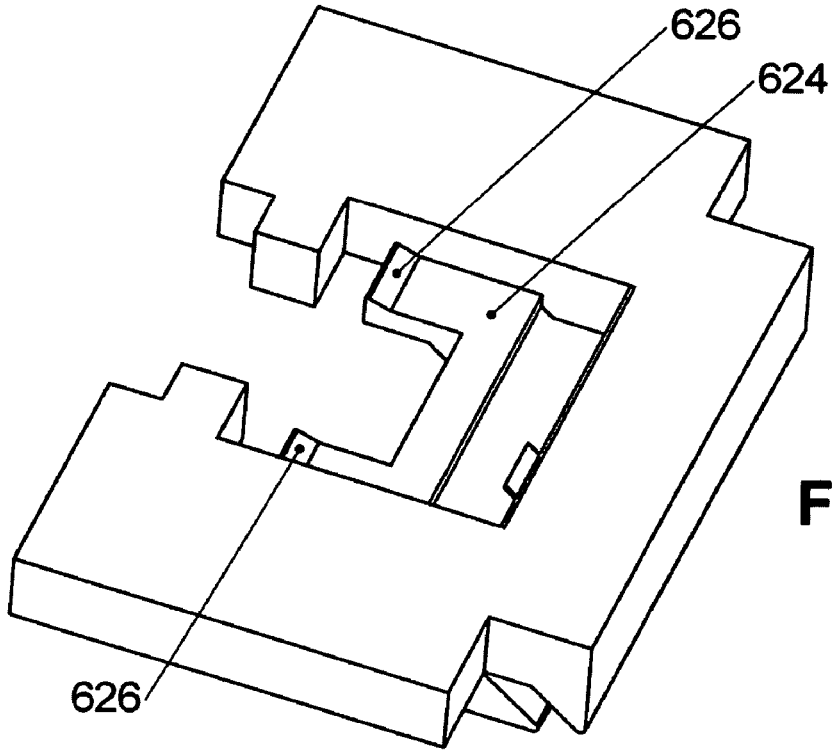
Figure 4:
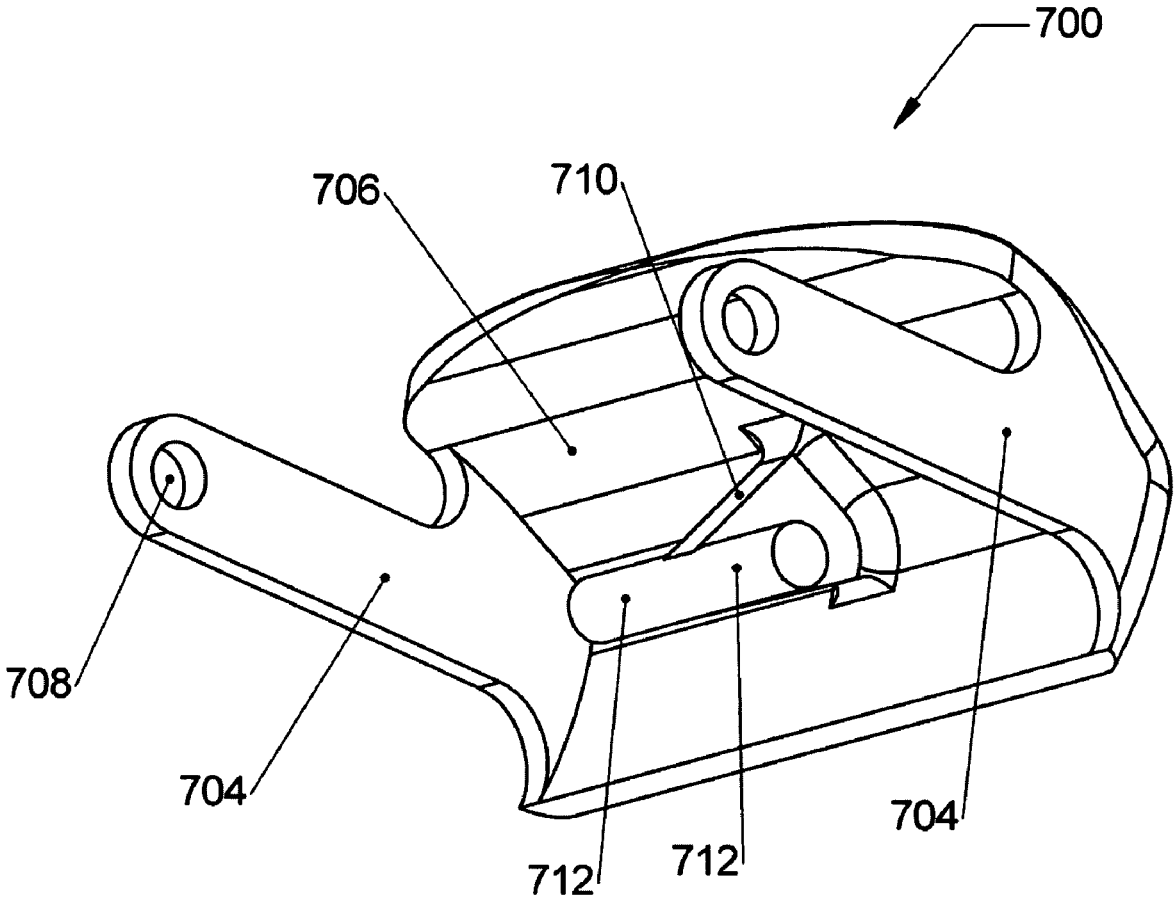
Figure 5:
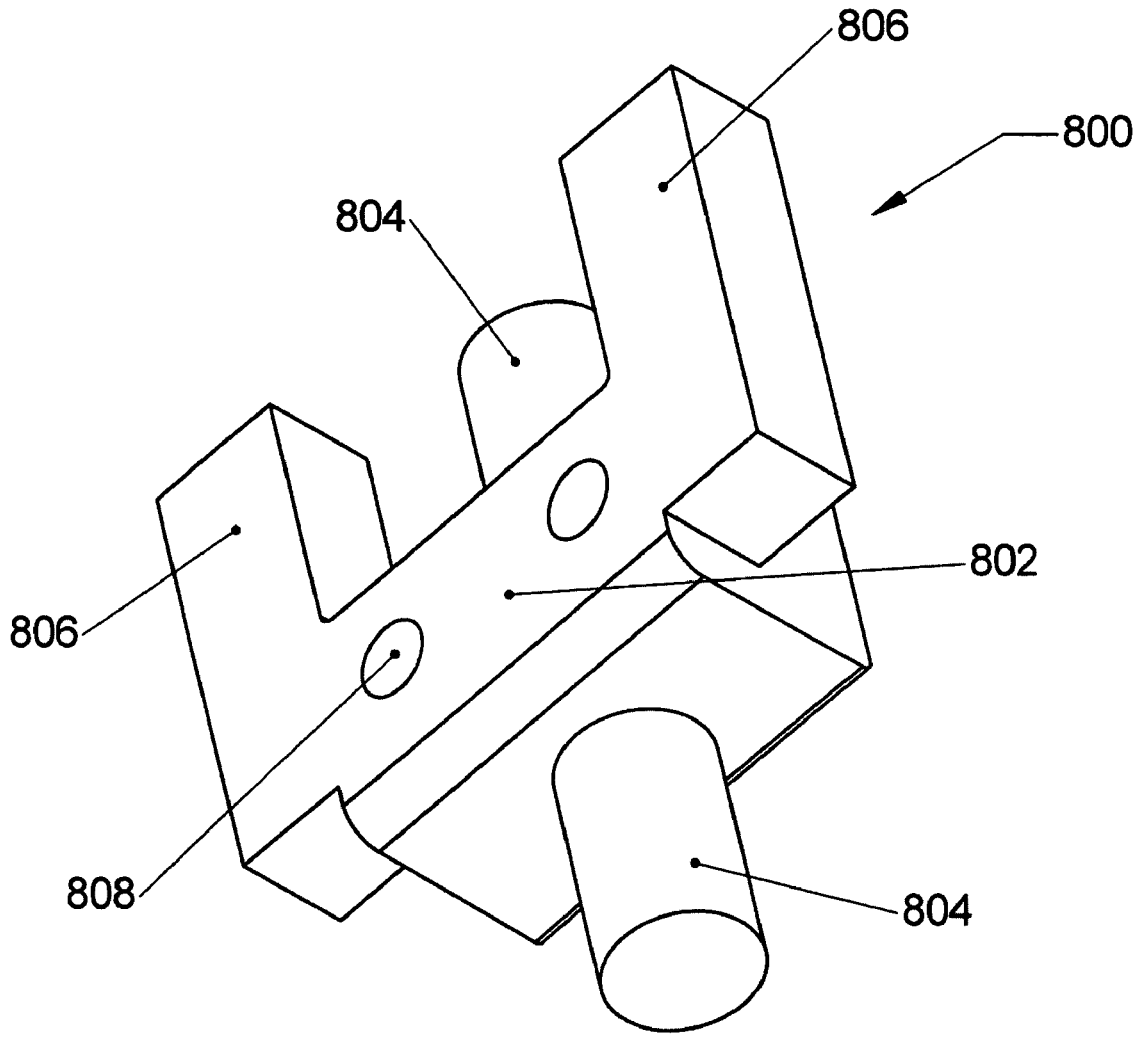
Figure 6:
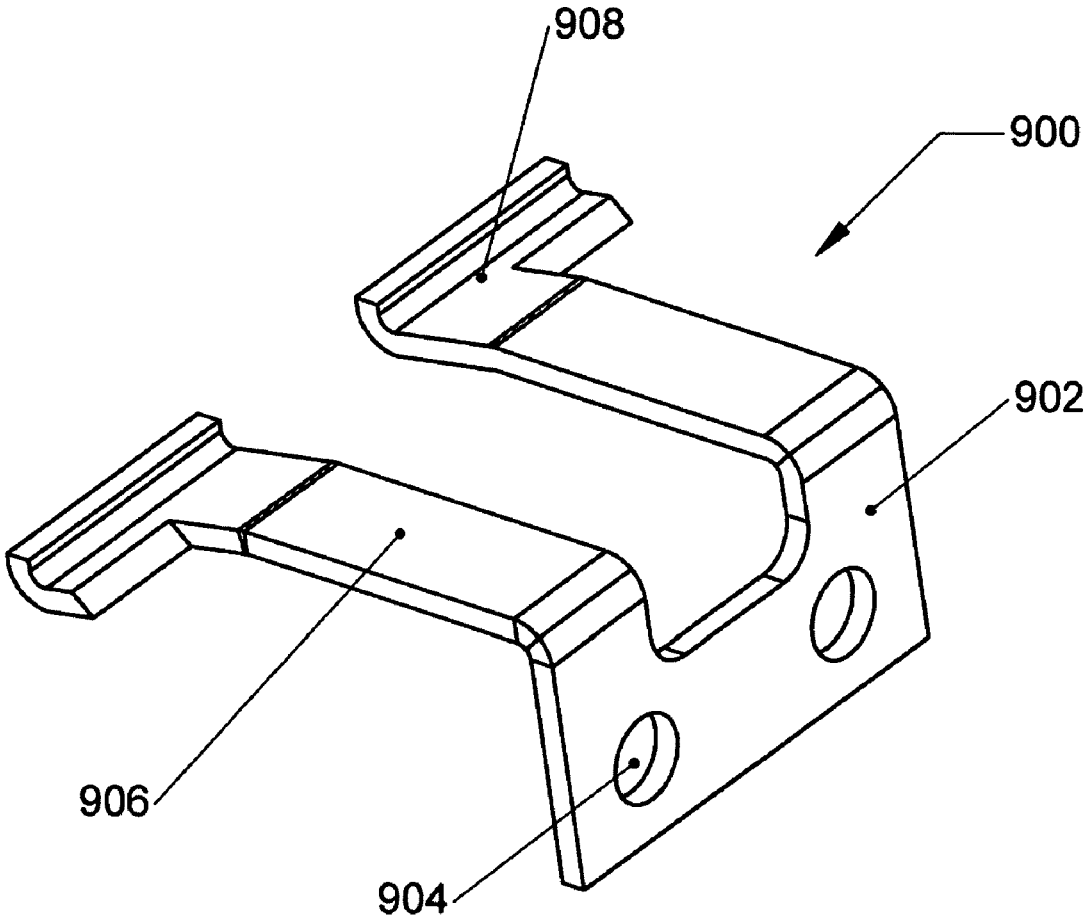

FIG. 3 illustrstes a top perspective view of a bolt-wedge of the positive action fenestration lock;

FIG. 3' illustrstes a bottom perspective view of a bolt-wedge of the positive action fenestration lock;

FIG. 4 illustrates a bottom perspective view of a button of an actuator of positive action fenestration lock;

FIG. 5 illustrates a perspective view of an actuator of positive action fenestration lock;

FIG. 6 illustrates a perspective view of a flat spring of positive action fenestration lock;

FIG. 7 illustrates a front view, in cross-section, of the positive action fenestration lock, when the window is closed and locked;

FIG. 7' illustrates a diagrammatic view, in profile, of FIG. 7;

FIG. 7" illustrates a diagrammatic view, in plan, of FIG. 7;

FIG. 8 illustrates a front view, in cross-section, of the positive action fenestration lock, when the window is closed and unlocked;

FIG. 8' illustrates a diagrammatic view, in profile, of FIG. 8;

FIG. 8" illustrates a diagrammatic view, in plan, of FIG. 8;

FIG. 9 illustrates a front view, in cross-section, of the positive action fenestration lock, when the window is open and unlocked;

FIG. 9' illustrates a diagrammatic view, in profile, of FIG. 9; and

FIG. 9" illustrates a diagrammatic view, in profile, of FIG. 9.

IV. DESCRIPTION OF THE PREFFERED EMBODIMENT

Referring to FIGS. 1 to 9", a positive action fenestration lock 100, according to the present invention, is adaptable to be attached to a moving window profile 200 and to interact, by sliding, with a fixed window profile 300.

Basically, positive action fenestration lock 100 comprises a hollow body 400, closed by a base plate 500;

a bolt-wedge 600, displaceable rectilinearly with respect to hollow body and base plate 400 and 500, respectively;

a button 700, located generally in hollow body 400 and pivotally connected to base plate 500;

an actuator 800 and a flat spring 900, the latter being attached to the former, control together the rectilinear movement of bolt-wedge 600, while the latter is activated by button 700;

a pair of restoring torsion springs 1000, located between base plate and button 500 and 700, respectively, resist against a torque caused by button 700, the latter being adaptable to be finger pressed by an operator; and a helical compression spring 1020 acting permanently on actuator 800 and, impliedly, on flat spring 900.

Describing now in detail, hollow body 400 includes a front wall 402, a pair of lateral walls 404, generally perpendicular to front wall 402, and an upper inclined wall 406 extending into front wall 402 and pair of lateral walls 404.

Opposite to front wall 402, a pair of spaced blocks 408, having a rectangular cross-section, extends inwardly from and perpendicularly on upper inclined wall 406. The pair of spaced blocks 408 has a height similar to a height of the pair of lateral walls 404, minus a thickness of base plate 500 compounded with a thickness of an adjacent part of a bolt-wedge 600. Between the pair of spaced blocks 408, there is a central block 410 provided with a cylindrical blind hole 412 and with a height relatively shorter than the height of the pair of spaced blocks 408.

Adjacent to each one of the pair of lateral walls 404 and opposite to front wall 402, i.e. in each corner formed between each one of the pair of lateral walls 404 and upper inclined wall 406, there is a double sleeve 414 that projects from upper inclined wall 406 and is joined to a proximate one of the pair of lateral walls 404. Each double sleeve 414 incorporates a through hole 416 and a dead hole 418, contiguous to the latter. The former and the latter are perpendicular to base plate 500. There is also a pair of sleeves 420 extending from front wall 402 and from upper inclined wall 406. The pair of sleeves 420 is equally spaced from the midway between the pair of lateral walls 404. Each sleeve 420 incorporates a dead hole 418' equivalent to dead hole 418. A height of double sleeves 414 and sleeves 420 is shorter than a height of front wall 402 and the pair of lateral walls 404. The foregoing difference in height equals to a thickness of a base plate 500 that is inserted into hollow body 400.

Upper inclined wall 406 incorporates a window 422, generally sized to enable a passage of button 700.

Base plate 500 includes a pair of lugs 502 struck from and perpendicularly disposed on it (on the latter). The pair of lugs 502 is so positioned as to partly flank the pair of spaced blocks 408. A pair of axles 504 extends perpendicularly from the pair of lugs 502 and is parallel to base plate 500.

Base plate 500 has a length 506, commensurate with an internal distance between the pair of lateral walls 404, and a width 508 commensurate with an internal distance measured between front wall 402 and outward ends of the pair of spaced blocks 408.

Base plate 500 further comprises a rectangular cut-off 510 centrally situated under central block 410 and so dimensioned as to allow a movement of actuator 800. An elongated cut-off 512 intended for a location of button 700, respectively a lower end portion of it, is disposed oppositely to rectangular cut-off 510. Base plate 500 incorporates as well several apertures 514 and 516 that correspond in size and coincide with through and dead holes 416 and 418.

Bolt-wedge 600 includes generally a flat base 602 of rectangular shape, defined by longitudinal and transversal axes 604 and 606, respectively. A slanted wall 608 protrudes, proximately to the longitudinal axis 604, from flat base 602 and is directed towards front wall 402 of hollow body 400. Slanted wall 608 is equally divided by a skewed slot 610 that coincides with transversal axis 606. A first end 612 of flat base 602, which is partly situated beneath slanted wall 608, is slope-shaped. A second end 614, opposite to first end 612, is provided with a first rectangular-shaped recess 616. The latter has such a width that allows a free passage of actuator 800, respectively a widest portion of it. The movement of actuator 800 is directed perpendicularly to flat base 602, in opposite directions.

First rectangular-shaped recess 616 is followed inwardly by a pair of opposite protrusions 618 which extend towards transversal axis 606. Behind the pair of opposite protrusions 618, there is a second rectangular-shaped recess 620 provided with a width somewhat larger than the width of first rectangular-shaped recess 616 and extending over an area relatively smaller than first rectangular-shaped recess 616. Behind the second rectangular-shaped recess 620, there is a third rectangular-shaped recess 622, which extends up to slanted wall 608, has a width commensurate with a distance between the pair of opposite protrusions 618 and communicates with second rectangular-shaped recess 620. The latter communicates with first rectangular-shaped recess 616. Flat base 602 incorporates a depressed zone 624 having a hollowness that starts from a bottom of the former. Depressed zone 624 extends longitudinally and transversally outside third rectangular-shaped recess 622 and has a width commensurate with second rectangular-shaped recess 620. Depressed zone 624 terminates with a rounded shoulder 626 directed towards the pair of opposite protrusions 618.

Button 700 comprises a curve-shaped structure 702 having at its lateral extremities a pair of projecting arms 704. The later projects perpendicularly from a bottom surface 706 of the former, i.e. inwardly, aproximately at 90° with respect to the foregoing curve-shaped structure 702; the pair of projecting arms 704 is provided at its ends with a pair engaging holes 708 for fitting with the pair of axles 504.

A lever 710, ending with a divided-in-two axle 712 perpendicularly to it, projects from bottom surface 706, midway between the pair of projecting arms 704.

A pair of bushes 714 is mounted on divided-in-two axle 712.

Bolt-wedge 600 can slide on base plate 500, while the pair of restoring torsion springs 1000 acts against the pair of projecting arms 704, from beneath them. In a first case, when a user presses button 700, divided-in-two axle 712, via the pair of bushes 714 acts on slanted wall 608. In a second case, when a user closes moving window profile 200, divided-in-two axle 712, via the pair of bushes 714 acts on first end 612 of flat base 602.

Actuator 800 includes a parallelepiped-shaped block 802 provided with a pair of cylindrical elements 804 extending centrally and in opposite directions from an upper and lower face of the parallelepiped-shaped block 802.

A pair of posts 806 flanks parallelepiped-shaped block 802, respectively the lateral faces of the latter. Each of the pair of posts 806 has a rectangular cross-section and is forwardly coplanar with a front face of parallelepiped-shaped block 802; the latter being provided with a pair of fastening apertures 808. An external distance between the pair of posts 806 corresponds to the width of first rectangular-shaped recess 616 and to rectangular cut-off 510.

Flat spring 900 comprises a front plate 902, corresponding in size to the front face of parallelepiped-shaped bloc 802, and has a pair of through apertures 904 coinciding with the pair of fastening apertures 808.

A pair of branches 906 extends from front plate 902, forming an inclination somewhat less than 90° between the former and the latter. Thus, when front plate 902 is assembled to the front face of parallelepiped-shaped bloc 802, the pair of branches 906 is upwardly biased.

Each one of the pair of branches 906 terminates with a lateral arm 908 that extends outwardly and is curved downwardly.

A pair of fasteners (not shown) is used to attach front plate 902 to the front face of parallelepiped-shaped bloc 802.

The pair of restoring torsion springs 1000 is assembled on the pair of axles 504 of base plate 500. Each restoring torsion spring of the pair of restoring torsion springs 1000 has one end tensioned against one of the pair of projecting arms 704, while another end is tensioned against base plate 500. As mentioned in the foregoing description, the pair of restoring torsion springs 1000 resist against a torque caused by a finger pressure on button 700.

Helical compression spring 1020 is mounted around one the pair of cylindrical elements 804 that extends centrally from the upper face of the parallelepiped-shaped bloc 802. Together, helical compression spring 1020 and the one the pair of cylindrical elements 804, which extends centrally from the upper face of the parallelepiped-shaped bloc 802 are disposed into cylindrical blind hole 412 of central block 410. Thus, helical compression spring 1020 acts permanently on the upper face of parallelepiped-shaped bloc 802.

Operation

1) Window Closed and Locked (See FIGS. 7–7")

Button 700 is articulated to base plate 500 and subjected to a permanent action by the pair of restoring springs 1000 operating against the pair of projecting arms 704, from their beneath. This causes divided-in-two axle 712, via its pair of bushes 714, to act on first end 612, which is is slope-shaped. In this situation, a front part of bolt-wedge 600 penetrates into fixed window profile 300, respectively into a groove 302 of it. The last operation can take place due to the fact that actuator 800, during the final closing of moving window profile 200, hits an interlock part 304 of fixed window profile 300. These results in an extra pressure on helical compression spring 1020 which allows actuator 800 to further penetrate into cylindrical blind hole 412 of central block 410, so that its parallelepiped-shaped block 802 will exit first rectangular-shaped recess 616. Thus, an advancement of flat base 602 of bolt-wedge 600 into groove 302 can freely occur. Flat spring 900, which is firmly secured to parallelepiped-shaped block 802, will have the lateral arms 908 of the pair of branches 906 located in depressed zone 624 of flat base 602, while the pair of branches 906 traverses first, second and third rectangular-shaped recesses 616, 620 and 622, respectively.

2) Window Closed and Unlocked (See FIGS. 8–8")

Pushing down button 700 causes a retraction of bolt-wedge 600 from groove 302 of fixed window profile 300; lateral arms 908 of the pair of branches 906 snap into second rectangular-shaped recess 620. Now the window is unlocked, but still in a closed position. Therefore, unlocking and opening of a window, according to the present invention, constitute separate operations. When a user releases button 700, parallelepiped-shaped block 802 is out of contact with flat base 602 of bolt-wedge 600, due to the fact that actuator 800 is still immobile; and this is because of the action of interlock part 304.

3) Window Opened (See FIGS. 9–9")

When a user pushes moving window profile 200 to separate from fixed window profile 300, a contact between actuator 800 and interlock part 304 of fixed window profile 300 ceases. As a result, helical compression spring 1020 acts, without being subjected to a supplementary pressure applied by interlock part 304 of fixed window profile 300, on the upper face of parallelepiped-shaped block 802. Thus, actuator 800, together with flat spring 900 firmly secured to parallelepiped-shaped block 802, is enabled to reach a fully extended position. Flat spring 900 having its pair of branches 906 and lateral arms 908 situated under a bottom surface of bolt-wedge 600 releases the latter. Simultaneously, parallelepiped-shaped block 802 of actuator 800 takes a position against the pair of opposite protrusions 618 of bolt-wedge 600, so that the latter cannot advance further. Now, moving window profile 200 is ready for a next operation: interacting with fixed window profile 300 for closing the window and triggering positive action fenestration lock 100 for locking the window.

It is obvious, that when moving window profile 200 is relocated in its closed position, actuator 800 collides with interlock part 304. This pushes the former back, until parallelepiped-shaped block 802 of actuator 800 looses the contact with opposite protrusions 618 of bolt-wedge 600. Thus, a locking of the window, due to an advancement of flat base 602 of bolt-wedge 600 into groove 302, can occur.

As required, a detailed embodiment of the present invention is disclosed in the foregoing description; however, it is to be understood that the disclosed embodiment is merely exemplary of the invention, which may be embodied in various forms. Therefore, specific structural and functional details disclosed therein are not to be interpreted as limiting, but merely as a basis for the claims and as a representative basis for teaching one skilled in the art to variously employ the present invention in virtually any appropriately detailed structure.

What is claimed is:

1. A positive action fenestration lock, adaptable to be attached to a moving window profile and to interact, by sliding, with a fixed window profile, said positive action fenestration lock, comprising a hollow body closed by a base plate;

bolt-wedge means for rectilinearly sliding on said base plate with respect to said hollow body during interactions between said moving window profile and said fixed window profile, as to establish any one of the following situations: a closed and locked window, a closed and unlocked window or an opened window;

a button generally located in said hollow body and pivotally connected to said base plate;

means for actuating;

a flat spring attached to said means for actuating for controlling together said bolt-wedge means for rectilinearly sliding when the latter is activated by said button;

a pair of restoring torsion springs located between said base plate and said button and resisting against a torque caused by said button, the latter being adaptable to be finger pressed by an operator; and a helical compression spring acting permanently on said means for actuating and on said flat spring.

2. The positive action fenestration lock, as defined in claim 1, wherein said hollow body includes a front wall, a pair of lateral walls, generally perpendicular to said front wall, and an upper inclined wall extending into said front wall and said pair of lateral walls; opposite to said front wall, a pair of spaced blocks, having a rectangular cross-section, extends inwardly from and perpendicularly on said upper inclined wall, said pair of spaced blocks being defined by a height having substantially a value equal to a height of said pair of lateral walls, said value being reduced with a first amount equal to a thickness of said base plate, but increased with a second amount equal with a thickness of an adjacent part of said bolt-wedge means for rectilinearly sliding; between said pair of spaced blocks, a central block, having a cylindrical blind hole and a height relatively shorter than said height of said pair of spaced blocks, being provided and adjacent to each one of said pair of lateral walls and opposite to said front wall, namely in each corner formed between each one of said pair of lateral walls and said upper inclined wall, a double sleeve projecting from said upper inclined wall being joined to a proximate one of said pair of lateral walls, each said double sleeve incorporating a through hole and a dead hole contiguous to the latter, the former and the latter being perpendicular to said base plate; a sleeve, extending from said front wall and from said upper inclined wall, being also provided; thus, a pair of sleeves, equally spaced from the midway between said pair of lateral walls being formed, each said sleeve incorporating a dead hole equivalent to said dead hole, a height of said double sleeves and said sleeves being shorter than a height of said front wall and said pair of lateral walls, said foregoing difference in height being equal to a thickness of said base plate that is inserted into said hollow body;

said upper inclined wall incorporating a window, generally sized to enable a passage of said button;

said base plate including a pair of lugs struck from and perpendicularly disposed on it, said pair of lugs being so positioned as to partly flank said pair of spaced blocks, a pair of axles extending perpendicularly from said pair of lugs and being parallel to said base plate, said base plate having a length substantially equal with an internal distance between said pair of lateral walls and a width substantially equal with an internal distance measured between said front wall and outward ends of said pair of spaced blocks, said base plate further comprising a rectangular cut-off centrally situated under said central block and so dimensioned as to allow a movement of said actuator; an elongated cut-off intended for a location of said button, respectively a lower end portion of it, being disposed oppositely to said rectangular cut-off; said base plate incorporating as well several apertures that correspond in size and coincide with said through and dead holes;

said bolt-wedge means for rectilinearly sliding including generally a flat base of rectangular shape, defined by longitudinal and transversal axes, while a slanted wall protruding, proximately to the longitudinal axis, from said flat base is directed towards said front wall of said hollow body, said slanted wall being equally divided by a skewed slot that coincides with transversal axis; a first end of said flat base, partly situated beneath said slanted wall being slope-shaped; a second end, opposite to said first end being provided with a first rectangular-shaped recess, the latter having such a width that allows a free passage of said actuator, respectively a widest portion of it, a movement of said actuator being directed perpendicularly to said flat base, in opposite directions; said first rectangular-shaped recess being followed inwardly by a pair of opposite protrusions extending towards said transversal axis; behind said pair of opposite protrusions, a second rectangular-shaped recess, having a width somewhat larger than a width of said first rectangular-shaped recess and extending over an area relatively smaller than said first rectangular-shaped recess, being provided; behind said second rectangular-shaped recess, a third rectangular-shaped recess extending up to said slanted wall and having a width substantially equal with a distance between said pair of opposite protrusions and communicating with said second rectangular-shaped recess being provided, the latter communicating with said first rectangular-shaped recess; said flat base incorporating a depressed zone having a hollowness that starts from a bottom of the former, said depressed zone extending longitudinally and transversally outside said third rectangular-shaped recess and having a width substantially equal with said second rectangular-shaped recess; said depressed zone terminating with a rounded shoulder directed towards said pair of opposite protrusions;

said button comprising a curve-shaped structure having at its lateral extremities a pair of projecting arms projecting perpendicularly from a bottom surface of the former, inwardly at 90° with respect to said foregoing curve-shaped structure; said pair of projecting arms being provided at its ends with a pair engaging holes for fitting with said pair of axles; a lever, ending with a divided-in-two axle perpendicularly to it, projecting from said bottom surface, midway between said pair of projecting arms; a pair of bushes being mounted on said divided-in-two axle; bolt-wedge means for rectilinearly sliding being able to slide on said base plate, while said pair of restoring torsion springs acts against said pair of projecting arms, from beneath them; in a first case, when pressing said button, said divided-in-two axle, via said pair of bushes is acting on said slanted wall; in a second case, when closing said moving window profile, said divided-in-two axle, via said pair of bushes is acting on said first end of said flat base;

said actuator including a parallelepiped-shaped block provided with a pair of cylindrical elements extending centrally and in opposite directions from an upper and lower face of said parallelepiped-shaped block; a pair of posts flanking said parallelepiped-shaped block, respectively its lateral faces; each of said pair of posts having a rectangular cross-section and being forwardly coplanar with a front face of said parallelepiped-shaped block; the latter being provided with a pair of fastening apertures; an external distance between said pair of posts corresponding to a width of said first rectangular-shaped recess and to said rectangular cut-off;

said flat spring comprising a front plate corresponding in size to a front face of said parallelepiped-shaped block and having a pair of through apertures coinciding with said pair of fastening apertures; a pair of branches, extending from said front plate, forms an inclination somewhat less than 90° between the former and the latter, thus, when said front plate is assembled to said front face of said parallelepiped-shaped block, said pair of branches is upwardly biased, each one of said pair of branches terminates with a lateral arm that extends outwardly and is curved downwardly;

a pair of fasteners being used to attach said front plate to said front face of said parallelepiped-shaped block;

said pair of restoring torsion springs being assembled on said pair of axles of said base plate, each one of said pair of restoring torsion springs having one end tensioned against one of said pair of projecting arms, while another end is tensioned against said base plate; and said helical compression spring being mounted around one of said pair of cylindrical elements that extends centrally from the upper face of said parallelepiped-shaped block, so that, together said helical compression springs and one of said pair of cylindrical elements that extends centrally from said upper face of said parallelepiped-shaped block are disposed into said cylindrical blind hole of said central block, thus said helical compression spring acts permanently on said upper face of said parallelepiped-shaped block.

* * * * *